US005415748A

United States Patent [19]

Emiliani et al.

[11] Patent Number: 5,415,748

[45] Date of Patent: * May 16, 1995

[54] PROCESS FOR THE ELECTROPHORETIC DEPOSITION OF DEFECT-FREE METALLIC OXIDE COATINGS

[75] Inventors: Mario L. Emiliani, North Palm Beach; Jarrett L. Spence, Jupiter, both of Fla.

[73] Assignee: United Technologies Corporation, Hartford, Conn.

[ * ] Notice: The portion of the term of this patent subsequent to Apr. 12, 2011 has been disclaimed.

[21] Appl. No.: 200,611

[22] Filed: Feb. 23, 1994

[51] Int. Cl.[6] ..... C25D 13/02

[52] U.S. Cl. ..... 204/181.5; 204/180.2

[58] Field of Search ..... 204/181.5, 180.2

[56] References Cited

U.S. PATENT DOCUMENTS

| | | | |
|---|---|---|---|
| 2,956,937 | 10/1960 | Thomson | 204/181 |
| 3,575,838 | 4/1971 | Hughes | 204/181 |
| 3,896,018 | 7/1975 | Powers et al. | 204/181 |
| 4,532,072 | 7/1985 | Segal | 252/313.1 |
| 4,801,399 | 1/1989 | Clark et al. | 252/315.01 |
| 4,810,339 | 3/1989 | Heavens et al. | 204/180.1 |
| 4,921,731 | 5/1990 | Clark et al. | 427/314 |
| 4,975,417 | 12/1990 | Koura | 505/1 |
| 5,302,265 | 4/1994 | Dalzell et al. | 204/181.5 |

OTHER PUBLICATIONS

Yoldas, B. E., "Alumina Sol Preparation from Alkoxides", American Ceramic Society Bulletin, vol. 54, No. 3 (1975), pp. 289–290.

*Primary Examiner*—John Niebling
*Assistant Examiner*—Kishor Mayekar

[57] ABSTRACT

A method is taught for the high speed, continuous electrophoretic deposition of a dense, uniform, and defect-free metallic oxide coating on a substrate, wherein bubbles of inert gas are passed adjacent the fiber core during its passage through the electrophoresis cell to disperse and remove hydrogen gas from the cell during electrophoresis.

19 Claims, 1 Drawing Sheet

PROCESS FOR THE ELECTROPHORETIC DEPOSITION OF DEFECT-FREE METALLIC OXIDE COATINGS

DESCRIPTION

1. Technical Field of the Invention

The present invention relates to the general area of metal oxide materials, and particularly to the application of an oxide or mixed oxide coating to a substrate by electrophoretic deposition of a colloidal material from a sol. More particularly, it relates to a specific improvement in the application of sols of metallic oxides, such as the oxides of aluminum, silicon, zirconium, titanium, chromium, lanthanum, hafnium, yttrium, and mixtures thereof, and their deposition on substrates, such as filaments, wires, or tows, by electrophoresis, to provide even, dense, defect-free and uniform coatings.

2. Background of the Invention

It is well known to apply coatings to the surface of a body so as to obtain surface properties which differ from those of the body. This may be done to achieve a variety of improvements, such as increased toughness, high temperature capability, debonding layers, diffusion barriers, oxidation resistance, wear resistance, and corrosion resistance. By providing surface coatings of the appropriate characteristics, it is possible to substantially lower the cost of an article built to specific property requirements. For example, metallic oxides have frequently been utilized to provide a surface coating over a less temperature resistant metallic article to permit use of that article in higher temperature environments. In addition, metallic oxides are frequently utilized to provide enhanced strength in metal matrix composites by inclusion in the form of powders, fibers, and whiskers. Metal oxide fibers, and fibers coated with metal oxides, are particularly suited for use as reinforcing elements in metal matrix composites.

In the past, various processes have been used to deposit metallic oxides and various ceramic materials upon a substrate. These include the application of glazes, enamels, and coatings; hot-pressing materials at elevated pressure and temperature; and vapor deposition processes such as evaporation, cathodic sputtering, chemical vapor deposition, flame spraying, and plasma spraying. In addition, thermophoresis and electrophoresis have been utilized, as have other specialized techniques, with limited success in application.

For example, the enamelling industry has used the electrophoretic deposition of ceramic materials for some time. In the application of a ceramic coating by this technique, a ceramic material is milled or ground to a small particulate or powder size, placed into suspension, and electrophoretically deposited on the substrate. Another traditional method is the deposition of a ceramic coating from a slurry made up of a powder in suspension, usually in an aqueous medium. A major problem with these techniques is that powder particle sizes below about 2 microns were difficult to obtain, thus limiting the quality of coatings produced.

Sol-gel technology has recently evolved as a source of sub-micron ceramic or metal oxide particles of great uniformity. Such sol-gel technology comprises essentially the preparation of metal oxides by low temperature hydrolysis and peptization of metal oxide precursors in solution, rather than by the sintering of compressed powders at high temperatures. In the prior art, much attention has been given to the preparation of sols of metal oxides (actually metal hydroxides or metal hydrates) by hydrolysis and peptization of the corresponding metal alkoxide, such as aluminum sec-butoxide [$Al(OC_4H_9)_3$], in water, with an acid peptizer such as hydrochloric acid, acetic acid, nitric acid, and the like. The hydrolysis of aluminum alkoxides is discussed in an article entitled "Alumina Sol Preparation from Alkoxides" by Yoldas, in American Ceramic Society Bulletin Vol. 54, No. 3 (1975), pages 289–290. This article teaches the hydrolysis of aluminum alkoxide precursor with a mole ratio of water/precursor of 100/1, followed by peptization at 90° with 0.07 moles of acid per mole of precursor. After gelling and drying, the dried gel is calcined to form alumina powder.

Additional references to the preparation of metallic oxides by sol-gel processing are numerous. For example, in U.S. Pat. No. 4,532,072, of Segal, an alumina sol is prepared by mixing cold water and aluminum alkoxide in stoichiometric ratio, allowing them to react to form a peptizable aluminum hydrate, and peptizing the hydrate with a peptizing agent in an aqueous medium to produce a sol of an aluminum compound.

In Clark et al, U.S. Pat. No. 4,801,399, a method for obtaining a metal oxide sol is taught whereby a metal alkoxide is hydrolysed in the presence of an excess of aqueous medium, and peptized in the presence of a metal salt, such as a nitrate, so as to obtain a particle size in the sol between 0.0001 micron and 10 microns.

In Clark et al, U.S. Pat. No. 4,921,731, a method is taught for ceramic coating a substrate, such as a wire, by thermophoresis of sols of the type prepared by the method of U.S. Pat. No. 4,801,399. In addition, Clark et al, in abandoned U.S. patent application 06/841,089, filed Feb. 25, 1986, teach formation of ceramic coatings on a substrate, including filaments, ribbons, and wires, by electrophoresis of such sols. However, the examples of this application indicate that the coatings obtained using electrophoresis were uneven, cracked, and contained voids or bubbles, and often peeled, flaked off, and/or pulled apart. Throughout, the evolution of hydrogen bubbles at the cathode during electrophoresis was noted.

Additional teachings of the electrophoretic deposition of various oxides are numerous. Such references include U.S. Pat. No. 2,956,937 of Thomson; U.S. Pat. No. 3,575,838 of Hughes; U.S. Pat. No. 3,896,018 of Powers et al; U.S. Pat. No. 4,810,339 of Heavens et al; and U.S. Pat. No. 4,975,417 of Koura.

One of the primary problems encountered in the deposition of coatings by electrophoresis is the evolution of gaseous hydrogen, which occurs upon application of voltages above about 3 volts DC to sols containing water and metal hydroxides or metal hydrates. The presence of bubbles of hydrogen in the sol during deposition on the substrate leads to voids, imperfections, and uneven coatings. The presence of hydrogen in the deposited coating is particularly undesirable, since its presence during the heating and drying steps results in creation of escape paths, and hence cracks in the final coating. One approach to decreasing hydrogen evolution during electrophoresis is to limit the amount of water present in the sol subjected to electrophoresis, since it is the disassociation of water to hydrogen and oxygen which results in the bubbles, which cause defects in the metal oxide layer deposited. This approach, however, is not always successful, and is frequently difficult to achieve due to the specific chemistry of the sol involved.

Thus, a need exists for a method for the electrophoretic deposition of metal oxide coatings on a substrate, especially a filament, fiber tow, or wire substrate, so as to form a uniform and dense coating without the formation of voids caused by hydrogen evolution. There is a particular need for a method for the high speed preparation of metal oxide fibers or fibers coated with a dense and defect-free metallic oxide, for use as reinforcing elements in metal matrix composites.

SUMMARY OF THE INVENTION

In the pursuit of a method for the high speed preparation of defect-free coatings of metallic oxides on various substrates, and especially on fibers, applicants have developed a novel improvement to the electrophoretic deposition process, especially suitable for the preparation of metal oxide coated fibers, or fibers themselves.

It is an object of this invention to provide a method for the electrophoresis of a sol so as to provide a uniform and defect-free coating on a substrate. The present invention provides a method for the deposition of a metallic oxide coating on a substrate, said method comprising the steps of providing a sol, electrophoretically depositing particles from said sol onto an electrically conductive substrate while actively removing the hydrogen gas generated by said electrophoresis, removing the metal hydrate coated substrate from said sol, heating the metal hydrate coated substrate to dry the coating and to transform said metal hydrate to the corresponding metallic oxide, and recovering the thus coated object.

The present invention further provides a method for the continuous high speed production of a metal oxide fiber, comprising the steps of continuously passing an electrically conductive fiber core through an electrophoresis cell containing a sol, applying a potential between said fiber core and another electrode immersed in said sol, whereby metal hydrate particles are continuously deposited on said fiber core, providing means for the dispersal and removal of hydrogen gas from the electrophoresis cell, and heating the fiber core and metal hydrate particles deposited thereupon after said fiber core emerges from said sol, so as to form a metal oxide fiber.

DETAILED DESCRIPTION OF THE INVENTION

Figure 1:
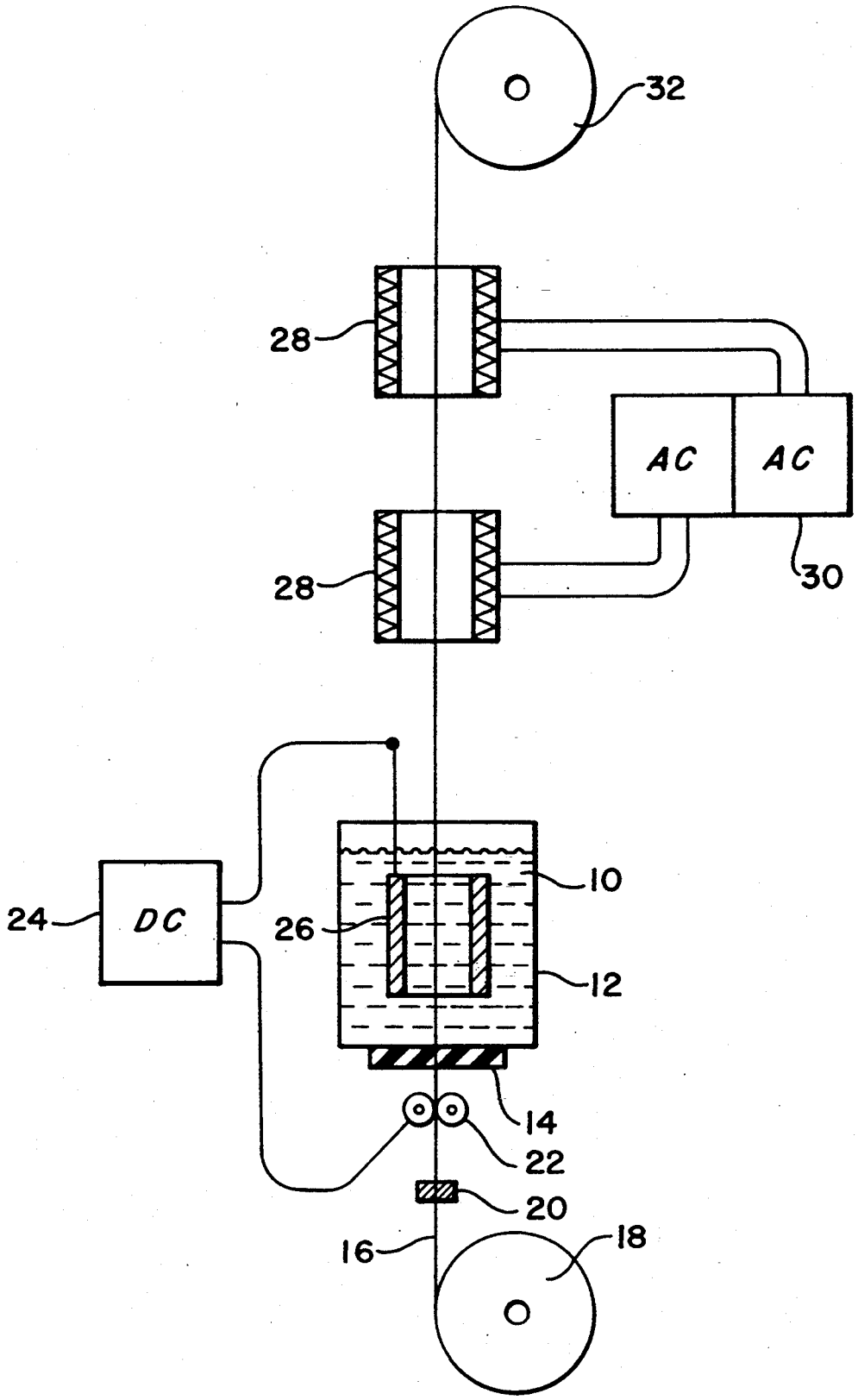
FIG. 1 represents a schematic of apparatus suitable for use in the present invention for the application of metallic oxide coatings to a fiber core from a sol by electrophoresis.

The present invention is directed to providing improved wear, electrical, thermal, and corrosion protection to both metallic and non-metallic substrates, by providing a method for the high speed application of very dense, defect-free and uniform coatings of metallic oxide materials.

Electrophoresis is an electrodeposition technique whereby minute particles of a normally nonconductive material in colloidal suspension are subjected to an external electric field and thereby caused to migrate toward a specific electrode. Colloids in solution are known to develop a surface charge relative to the suspension medium, as a result of any of a number of possible mechanisms, such as lattice imperfection, ionization, ion absorption, and ion dissolution. In the case of metal oxides such as alumina, the surface charge is the result of ionization, and is generally positive in the preferred pH range, below about 7. During electrophoresis, the positively charged colloids migrate toward the cathode, forming a compact layer of particles thereupon. The physical properties of the deposited coatings are related to their compaction on, and adherence to, the substrate. Generally, tile greater the compaction of the colloidal particles deposited upon the substrate, the better the mechanical properties of the coating and the greater the protection afforded thereby.

The present invention may be utilized to electrophoretically deposit coatings on a wide range of substrates, both metallic and non-metallic. Exemplary substrate materials include non-metallic materials such as carbon, glass, silicon carbide, silicon nitride, and alumina, and such metals as aluminum, iron, chromium, nickel, tantalum, titanium, molybdenum, tungsten, rhenium, niobium, and alloys thereof. In general, any material known to be electrically conductive, or which may be made electrically conductive, is capable of being utilized. While the present invention may be used to deposit metallic oxides on a variety of substrates, it is particularly useful for making metallic oxide coated fibers, and for producing metallic oxide fibers, as defined hereinabove. Thus, while the discussion and examples which follow are specific to deposition of metallic oxide coatings on a fiber core, it is understood that the invention is equally applicable to planar forms such as airfoils, and to structural materials of any suitable configuration and shape.

As used herein, the term "filament" shall refer to a single strand of fibrous material, "fiber tow" shall refer to a multi-filament yarn or array of filaments, and a "wire" shall refer in general to metallic filaments or tows. A "fiber core" shall indicate a filament, fiber tow, or wire suitable for coating by the process of this invention, and the terms "metallic oxide coated fiber" or "coated fiber" shall refer to a fiber core of an electrically conductive material, or a material which has been made to be conductive such as by a flash coat of carbon or a metallizing layer, upon which has been deposited a uniform metallic oxide layer, such that the diameter of the fiber core is greater than the thickness of the applied coating. Conversely, for convenience, the term "metallic oxide fiber" or "fiber" shall refer to an electrically conductive fiber core material upon which has been deposited a uniform metallic oxide layer, such that the thickness of the layer exceeds the diameter of the fiber core. This distinction of relative thickness of surface layer and core is industry recognized to define between coated fiber and fiber. In either case, of course, the fiber core material may be removed by such techniques as acid dissolution, combustion, etc., to leave a hollow metallic oxide cylinder, which may, of course, then be referred to as a metallic oxide fiber.

The size of the substrate, e.g. the diameter of the fiber core, is not critical, and may be chosen in accordance with the desired size and end usage of the coated substrate to be produced. Fiber core diameters of from about 0.1 mil to about 3 mil or larger are suitable, recognizing the possible goal of achieving a metal oxide layer which is thicker than the fiber core, and the possible elimination of said core. The final diameter of the fiber produced may be from about 0.3 mil (or smaller) to about 10 mil (or larger) depending upon the strength and other characteristics required.

It is to be noted that the present invention is directed to the solution of a number of problems which have been encountered in the art of electrophoresis. First, it has been known that the evolution of hydrogen during electrophoretic deposition is a source of many problems and defects in the coatings obtained. In fact, the application of voltages above about 3 volts DC results in hydrogen evolution due to the breakdown of the water present in the sol. Conversely, limiting the voltage of the electrophoresis process to below 3 volts severely limits both the rate of deposition and the density thereof. The present invention attempts to overcome these problems by providing means for the dispersal and removal of that hydrogen which does evolve, and permitting the deposition of dense, uniform and defect-free metallic oxide coatings. These goals may be further enhanced by replacement of water in the sol, to the greatest extent possible, with an organic solvent, e.g. an alcohol; by utilizing a low potential in combination with moving the fiber core at an appropriate rate of speed to increase the thickness of the deposited layer; closely controlling sol content and density so as to maintain the minimum concentration of water at the electrodes; and, generally, operating at appropriate voltages and rates of deposition and fiber core throughput to achieve the goal of a hydrogen-free deposition.

Sols which may be electrophoretically deposited in accordance with the present invention include sols and colloids of metallic oxides, such as the oxides of aluminum, silicon, zirconium, titanium, lanthanum, hafnium, yttrium, and mixtures thereof such as YAG, yttrium aluminum garnet. While the method of preparation of such sols is not considered a part of the present invention, those sols having the smallest average particulate size and the least volume of water present are considered most suitable for use in electrophoresis. In general, sols suitable for use in the present invention may be prepared by the hydrolysis and peptization of a variety of corresponding organometallic compounds in an aqueous medium. Preferred organometallic compounds are metal alkoxides, and particularly the metal sec-butoxides, ethoxides, and methoxides of such metals as aluminum, yttrium, and mixtures thereof. In a preferred method for preparation of a sol suitable for deposition upon a fiber core by the method of the present invention, organometallic compounds are hydrolyzed and peptized to obtain a sol having a colloidal particle size of from about 10 Angstroms to about 150 Angstroms. A preferred range of particle size is from about 50 Angstroms to about 100 Angstroms. Within these ranges of particle sizes, good contact of the coating materials is attained with the fiber core, giving excellent adhesion, and excellent packing of the coating particles within the coating layer is obtained, resulting in superior coating properties such as wear resistance, and thermal high temperature capability. Suitable techniques for the preparation of such a sol are set forth in co-pending U.S. patent application 07/637,717, filed Jan. 1, 1991 by Wright and Dalzell, incorporated herein by reference. This reference teaches the preparation of sols by a process consisting of the steps of concurrent hydrolysis and alcoholization of an organometallic compound in an aqueous medium comprising water and an alcohol; the peptization of this reaction mixture with a monovalent acid or acid source; dehydration and de-alcoholization of the reaction mixture by removal of the excess aqueous phase; dewatering and further removal of unreacted alcohol by evaporation; and re-alcoholization by addition of a second alcohol to the concentrated sol to form a sol wherein the molar ratio of alcohol to metal hydrate is from about 50 to about 70, and the particle size of said metal hydrate is from about 10 to about 150 Angstroms. Other sols may also, however, be used in the process of the present invention, which is not to be limited to any specific sol or process for preparation thereof, subject to the determination of any specific modifications necessary.

A sol suitable for use in the present invention may be prepared in the following manner, in accordance with the teachings of the above cited U.S. patent application 07/637,717, with particular attention being given to prevention of exposure of the reaction mixture to air. While the example is specific to the preparation of an alumina forming sol formulated from an aluminum sec-butoxide precursor, the present invention is not to be limited thereto.

EXAMPLE 1(A)

Preparation of an Alumina Sol

For the preparation of an alumina sol, a 4000 ml glass reaction vessel was assembled with a variable temperature heating mantel, glass/TEFLON stirring rod with a laboratory mixer having variable speed control, an injection port with a TEFLON tube for insertion of liquids to the bottom of the reaction vessel, and a water-cooled PYREX condenser. After turning on the flow of cooling water to the condenser, 2500 grams (corresponding to 138.8 moles or 2500 ml) of deionized water was metered into the closed reaction vessel, after which the heating mantel was turned on to raise the temperature of the water to between 88° C. and 93° C., which temperature was thereafter maintained. The mixer motor was turned on when the water had reached this temperature, and the water was vigorously stirred. In a separately sealable glass transfer container, 357.5 grams (corresponding to 1.5 moles or 357.5 ml) of aluminum sec-butoxide [$Al(OC_4H_9)_3$] was mixed with 288.86 grams (corresponding to 3.897 moles or 357.5 ml) of 2-butanol. Experience has taught that exposure of this mixture, or the aluminum sec-butoxide, to air for any longer than the absolute minimum necessary adversely affected the sol produced, so great care was exercised to avoid exposure. The mixture of sec-butoxide and butanol, in the transfer container, was connected to the reaction vessel entry port after the water had reached the desired temperature, and very slowly, over a 5 minute period, metered directly down into the hot deionized water. When all of the mixture had been introduced into the water, the entry port was valved shut and the transfer container removed. The mixture of water, sec-butoxide, and butanol was then permitted to hydrolyse for a period of 1 hour at temperature while stirring vigorously.

After 1 hour, and with the mixture still at temperature and being stirred vigorously, the sol mixture was peptized by connecting a glass syringe containing 8.18 grams (0.224 moles or 6.875 ml) of hydrochloric acid to the vessel entry port. The entry valve was opened and the acid metered directly down into the sol mixture. The valve was then closed, and the syringe removed and refilled with air. The syringe was then reconnected to the entry port, and the air injected into the vessel to ensure that all of the acid had been introduced into the system. The valve was then closed, and the syringe removed.

The heat and stirring were maintained until the sol cleared, about 16 hours. The heat was then turned off and the stirrer and motor assembly removed. After the mixture cooled, the sol and alcohol separated, and the alcohol was removed by pipette. It was found that leaving a small amount of alcohol in the sol did not adversely affect the sol. The pH of the sol was measured and found to be pH 3.90. This initial sol was found to have a good shelf life, and could be stored prior to further processing to obtain a sol suitable for electrophoresis.

A sol was then specifically formulated for the express purpose of making coated fibers in a continuous process. This specific formulation was also found to be suitable for coating fiber cores or other substrates with a composite coating material, wherein the composite included any chopped fiber material, platelets, powder, or particulates, of metals or other materials in the alumina matrix.

This sol was derived from the initial sol prepared above. A 390 ml sample of the sol prepared above was heated in an open glass beaker to a temperature of approximately 93° C., and the volatiles, alcohol and excess water, evaporated off. The sol was heated until it had been reduced to 250 ml, i.e. to 64 percent of its initial volume, with a noted increase in viscosity. The reduced sol was then removed from the heat and permitted to cool to room temperature. The reduced sol was then re-alcoholized with 750 ml of ethyl alcohol (63 moles of alcohol/mole of aluminum hydrate present). The sol and alcohol were vigorously mixed, then sealed in an air tight container for storage. The pH of this sol was about pH 3.8. This sol was set aside for 5 months, demonstrating good shelf life, and then subjected to electrophoretic deposition.

EXAMPLE 1(B)

Deposition of the Sol

To electrophoretically deposit a thick metallic oxide coating on a fiber core, apparatus such as shown generally in FIG. 1 may be used. Any fiber core may be coated in accord with this invention, if it is electrically conductive, or can be so treated as to be made electrically conductive. For example, fibers of aluminum, carbon, copper, silver, platinum, etc., are normally conductive, while fibers of cotton, polyester, etc., must be made conductive to be used in the present invention. Such fibers may, for example, be coated with a conductive metal or carbon, by conventional coating techniques such as chemical vapor deposition, physical vapor deposition, etc, dependent upon the specific materials.

A fiber core may be electrophoretically coated by applying a controlled electrical potential within a colloidal solution of charged particles, with the colloids being driven towards the fiber, acting as a cathode, at a specific rate controlled by the sol chemistry and the applied electrical potential between the metallic electrodes. The metal anode may be copper, aluminum, silver, gold, platinum, or another electrically conductive metal, but platinum is the preferred material for the anode. The fiber core, being electrically conductive, is the cathodic surface for purposes of electrophoresis of a positively charged sol. If a basic peptizer is utilized in preparation of the sol, the electrodes would, of course, be reversed. The colloidal particles collect in a uniform manner about and along the fiber core, producing a thick, dense, uniform, adherent coating, the chemistry and mechanical properties of which are determined by the sol chemistry, applied electrical potential, and post-coating heat treatment. As a continuous length of fiber core is drawn through the sol, the coating process is effectively continuously repeated. Depending on the coating structure desired, after the fiber core is coated it may be drawn through a furnace, laser, or other controlled heat source, at an appropriate temperature. The process may be better understood from an examination of FIG. 1.

A sol, or colloidal solution, 10, is contained in a sol reservoir 12, having a membrane 14, at the lower end. A conductive fiber core 16, from supply spool 18, is first cleaned (at cleaner 20) by a heat source, such as a laser or furnace, a chemical bath, or other suitable cleaning means, prior to contacting either a pair of or a single roller or pulley 22, which is connected to a variable DC power source 24. The fiber core thence passes through the sealing membrane 14, through the sol 10, and through the annular anode 26. It is noted that while the drawing illustrates a vertical anode/sol reservoir, with the fiber core passing upward through the annular anode, it is possible to have the reservoir and anode disposed at any appropriate angle. The length of the anode may be readily increased by this positioning, and may be extended to 20 feet or longer. During passage through the annular anode, the sol is subjected to electrophoretic force, and the particulate metal oxide is deposited upon the fiber core. Dependent upon such factors as the applied voltage, hydrogen evolution occurs at the surface of the fiber core during this deposition. The removal of hydrogen from the deposit as it is formed is of particular importance, since its presence during the subsequent heating and drying steps results in creation of voids, or escape paths, and hence cracks.

We have found the most effective approach to hydrogen removal is to provide a continuous flow of air bubbles, or bubbles of an inert gas, such as argon or nitrogen, to sweep the surface of the fiber core and the coating being deposited thereupon, and to remove hydrogen bubbles as they form. As illustrated in FIG. 1, these bubbles may be provided from a gas source 34, via a pipe, conduit or injection means 36 which passes through the sealing membrane 14, to a point adjacent to but not contacting the fiber core 16, prior to entry into the annular anode 26. The flow rate of the gas should be sufficient to provide scrubbing bubbles, 40, which are preferably large relative to the size of the hydrogen bubbles formed by the electrophoresis and should flow upward at a rate which exceeds the rate of movement of the fiber core through the sol, so as to permit the air or inert gas to sweep away any hydrogen formed, while not depleting the source of metal oxide ions to be deposited on the fiber. That is, the flow of gas should not be so great as to cause undue turbulence in the sol, or to cause uneven deposition. The hydrogen is carded by the scrubbing bubbles to the surface of the sol, or top of the electrophoresis cell, where it is released to the atmosphere, or evacuated. Such bubbles may be generated in conventional fashion, or provided from a compressed gas source. This creates an escape path for hydrogen gas at the point of separation of sol and coated fiber.

After having been electrophoretically coated during passage through the annular anode 26, the coated fiber core passes through a furnace or furnaces 28, for drying and phase transformation of the coating. The furnaces are illustrated as being electric, with AC power sources 20, but any form of heating source may be utilized. The metallic oxide coated fiber core may now be collected on take-up spool 32. If the coating material is permitted to deposit to a thickness greater than the fiber core, this may now appropriately be referred to as a metal oxide fiber.

Such apparatus is useful for the production of metal oxide coated fibers, or metal oxide fibers per se, dependent upon control of variables such as rate of fiber core passage through the annular anode, applied potential at the anode, density of the sol, and hydrogen bubble removal measures. These factors are determinative of the degree of success achieved in the preparation of defect-free, uniformly distributed, compact, and strongly adherent metallic oxide coatings.

The rate of fiber core throughput also requires consideration and adjustment of electrical potential to achieve the coating thicknesses desired. Low voltage results in less hydrogen evolution, but also requires a longer period of electrophoresis to attain a thick deposit. This may be achieved by either slowing the rate of fiber core passage, or lengthening the anode itself. Increased voltage, on the other hand, increases the rate of hydrogen evolution. Accordingly, the rates of fiber core throughput and coating voltage should be adjusted in accordance with the coating thickness desired and the specific sol and fiber core employed. It has been found that potentials of from about 0.1 volt to about 100 volts or higher may be employed, preferably from about 1 to about 50 volts, and most preferably from about 35 to about 50 volts, with the fiber core subjected to a deposition period (i.e. the time of passage of a specified point on the fiber core through the length of the annular anode) dependent upon the specific conductivity of the fiber core, the specific composition of the sol, and the voltage applied. Thus, the coating rate may vary greatly. For example, a fiber core may be coated by an yttrium-alumina-garnet sol at a much faster rate of fiber movement and a much lower voltage than the same fiber may be coated with an alumina sol.

As indicated, variation in the length of the anode will also influence these factors, with a longer anode permitting faster fiber core movement and/or lower voltages to achieve similar results. These parameters may be adjusted as desired. It is noted that for purposes of obtaining defect-free, uniform and strong fibers, it is preferable to operate at throughput rates of at least 500 feet per hour, preferably from about 1200 to about 1600 feet per hour, and voltages of from 35 to 50 volts, in the presence of a sweeping continuous flow of bubbles, thereby eliminating the formation of cracks or voids in the deposition resulting from the presence of hydrogen. To obtain the best quality fibers, electrophoresis at less than about 50 volts is recommended, although quite acceptable fibers may be obtained at potentials up to 100 volts, in the presence of the flow of bubbles, dependent upon the specific sol and the rate of fiber core passage through the sol.

The removal of hydrogen from the surface of the fiber core may also be aided by mechanical means, such as by vibration, including ultrasonic vibration of the sol. However, such means may, if applied too vigorously, remove the uncured coating from the substrate.

An additional factor in achieving successful deposition is the density of the metal hydrate in the sol, i.e. the availability of material for deposition. This may be influenced by recirculation of the sol to maintain a nearly constant concentration. A large sol holding tank, not illustrated, may be utilized, with a recirculating pump to cause the flow of sol through the sol reservoir 12, with fresh sol added as appropriate to maintain the desired concentration.

After passage through the sol reservoir, the newly coated fiber core, bearing a deposit of metal hydrate, must be dried. While air drying may be used, this approach is much too slow and limiting for a continuous process and would result in a hydrate coating as opposed to an oxide. Preferably, the coated fiber core should be passed through a heated drying zone, such as a furnace, to remove any water and/or alcohol entrapped by the deposited particulate matter during electrophoresis, and to achieve transformation of the hydrate to an oxide. It is noted that if the thickness of the coating layer is greater than the diameter of the fiber core, a metallic oxide fiber is obtained, by definition. Dependent upon the time and temperature of this heating or curing step, one may control the degree of phase transformation to obtain the desired phase of metallic oxide in the surface layer. The appropriate temperatures for curing of the hydrate are within the skill of the operator and may easily be determined, but temperatures from about 850° F. to about 1200° F. and above are appropriate for oxide formation from the metallic hydrate. It is to be noted that in some instances, the fiber core per se is consumed during the curing process, after long periods at elevated temperature, resulting in a "free-standing" metallic oxide cylinder, tube, or jacket, i.e. metal oxide fiber. Depending upon packing density, degree of phase transformation, thickness of metal oxide, etc., this metal oxide fiber may exhibit varying degrees of flexibility, but in most instances may be wound upon a collection spool of approximately 4 inch diameter or greater. Such flexibility is of great value in the use of such fibers.

Coatings have been applied to various fiber cores in accordance with this invention, to produce coated fibers suitable for inclusion in metal matrix composites, wherein the oxide fibers serve as reinforcement and/or strengthening inclusions.

EXAMPLE 2

An alumina sol produced as in Example 1 was used to electrophoretically deposit a 4 mil thick coating on a 0.5 mil diameter wire of tungsten—3 percent rhenium alloy. A strongly adherent coating was obtained by deposition in accordance with the method set forth above, and after curing, a fiber of $Al_2O_3$ of approximately 8 mil cross-section was obtained.

EXAMPLE 3

A sol comprising alumina doped with 3 weight percent chromium was prepared in accordance with Example 1. Using the deposition process of this invention, a thick layer of chrome ion doped alumina was electrophoretically deposited on a 2 mil diameter wire of Incoloy 909 alloy. After curing, an alumina fiber approximately 6 mils in diameter was obtained.

EXAMPLE 4

An alumina sol was subject to electrophoresis at 35 volts as set forth above, utilizing a 12.5 micron wire of tungsten—3 rhenium at a rate of 1500 feet per hour. A coating of 6–8 microns thickness was applied, yielding a fiber having a diameter of about 25–28 microns. When the throughput rate of the fiber core was decreased to 750 feet per hour, at the same potential, the coating thickness doubled, giving an alumina fiber of about 40 microns, illustrating the direct relationship between feed rate and results.

EXAMPLE 5

A thick coating of alumina hydrate was deposited upon a niobium fiber core by the process above. When cured at 1200° F., the niobium core was oxidized, leaving a hollow cylinder of alumina.

EXAMPLE 6

A one mil diameter tungsten core was coated with a sol comprising alumina and molybdenum disilicide. An alumina sol comprising about 10 volume percent alumina was prepared as above, and mixed with about 1 to 10 volume percent molybdenum disilicide particulates, having a particle size of from about 1 to 5 microns. The mixture was electrophoretically applied to the tungsten core at about 40 volts, to a thickness of about 10 mils, using the scrubbing bubble method of the present invention. The turbulence created by the bubble flow kept the heavier molybdenum disilicide powder suspended in the sol, resulting in an evenly dispersed molybdenum disilicide reinforced alumina coating.

EXAMPLE 7

Blades from the first stage turbine of a gas turbine engine were polished, cleaned, degreased, and prepared for coating. The blades were individually immersed in an alumina sol bath made in accordance with Example 1(A) above, with platinum foil anodes surrounding each blade. During electrophoresis at 200 volts, nitrogen gas was passed through cooling holes in the blades to provide the scrubbing effect of the present invention. In addition to preventing formation of hydrogen bubble defects, the nitrogen flow prevented alumina deposition in the cooling holes and internal passages of the airfoils. A coating of 1 mil thickness was achieved in about 2 minutes dwell time in the electrophoretic bath.

Thus, the present invention demonstrates utility for electrophoretic deposition of metallic oxides on a variety of substrates, but particularly on fibers. Such fibers have great potential for use as reinforcement fibers in various matrix composites.

It is to be understood that the above disclosure of the present invention is subject to considerable modification, change, and adaptation by those skilled in the art, and that such modifications, changes, and adaptations are to be considered to be within the scope of the present invention, which is set forth by the appended claims.

We claim:

1. In a process for the electrophoretic deposition of a metallic oxide on a substrate, said process comprising providing a sol comprising metal hydrate particles suspended in an aqueous medium or a medium comprising an organic solvent, electrophoretically depositing particles from said sol onto an electrically conductive substrate by applying a direct current potential between said substrate and an anode, removing the metal hydrate coated substrate from said sol, heating the metal hydrate coated substrate to dry the coating and to transform said metal hydrate to the corresponding metal oxide, and recovering the coated substrate, the improvement which comprises passing gas bubbles over said substrate to remove hydrogen from the substrate while electrophoretically depositing said metal hydrate thereupon.

2. The improvement as set forth in claim 1, wherein said substrate is selected from the group consisting of aluminum, iron, chromium, nickel, tantalum, titanium, molybdenum, tungsten, rhenium, niobium, alloys thereof, carbon, glass, silicon carbide, silicon nitride, and alumina, wherein said glass, silicon carbide, silicon nitride, and alumina have been made electrically conductive.

3. The improvement as set forth in claim 2, wherein said metallic oxide is selected from the oxides of aluminum, silicon, zirconium, titanium, chromium, lanthanum, hafnium, yttrium, and mixtures thereof.

4. The improvement as set forth in claim 3, wherein said substrate is a non-metallic fiber core selected from the group consisting of carbon, glass, silicon carbide, silicon nitride, and alumina.

5. The improvement as set forth in claim 4, wherein said gas bubbles are selected from the group consisting of air and inert gases.

6. The improvement as set forth in claim 5, wherein said potential is from about 1 to 100 volts direct current.

7. The improvement as set forth in claim 3, wherein said substrate is a metallic fiber core selected from the group consisting of aluminum, iron, chromium, nickel, tantalum, titanium, molybdenum, tungsten, rhenium, niobium, and alloys thereof.

8. The improvement as set forth in claim 7, wherein said gas bubbles are selected from the group consisting of air and inert gases.

9. The improvement as set forth in claim 8, wherein said potential is from about 1 to 100 volts direct current.

10. The improvement as set forth in claim 9, wherein said metallic oxide is alumina.

11. A method for the continuous production of a metal oxide fiber, comprising continuously passing an electrically conductive fiber core through an electrophoresis cell containing a sol comprising metal hydrate particles, applying an electrical potential between said fiber core and another electrode immersed in said sol, whereby said metal hydrate particles are continuously deposited on said fiber core to a thickness equal to or greater than the diameter of said fiber core, passing bubbles of inert gas adjacent the fiber core during its passage through the cell to disperse and remove hydrogen gas from the electrophoresis cell during the deposition of said metal hydrate particles, and heating the fiber core and metal hydrate particles deposited thereupon after said fiber core emerges from said sol, so as to form a metal oxide fiber.

12. The improvement as set forth in claim 11, wherein said substrate is selected from the group consisting of aluminum, iron, chromium, nickel, tantalum, titanium, molybdenum, tungsten, rhenium, niobium, alloys thereof, carbon, glass, silicon carbide, silicon nitride, and alumina, wherein said glass, silicon carbide, silicon nitride, and alumina have been made electrically conductive.

13. A method as set forth in claim 12, wherein said metallic oxide is selected from the group consisting of the oxides of aluminum, silicon, zirconium, titanium, chromium, lanthanum, hafnium, yttrium, and mixtures thereof.

14. A method as set forth in claim 13, wherein the electrical potential is from about 1 to 100 volts direct current.

15. A method as set forth in claim 14, wherein said metallic oxide is alumina, and said fiber core is selected from the group consisting of aluminum, iron, chromium, nickel, tantalum, titanium, molybdenum, tungsten, rhenium, niobium, and alloys thereof.

16. A method as set forth in claim 13, wherein said metal oxide fiber is from about 0.3 to about 9 mils in diameter.

17. A method as set forth in claim 16, wherein said fiber core is passed through said electrophoresis cell at a rate greater than 500 feet per hour.

18. A method as set forth in claim 17, wherein the electrical potential is from about 35 to 50 volts direct current.

19. A method as set forth in claim 18, wherein said fiber core is passed through said electrophoresis cell at a rate of from about 1200 to 1600 feet per hour.

* * * * *